US009587507B2

(12) United States Patent
Ottow

(10) Patent No.: US 9,587,507 B2
(45) Date of Patent: Mar. 7, 2017

(54) BLADE CLEARANCE CONTROL FOR GAS TURBINE ENGINE

(71) Applicant: Rolls-Royce North American Technologies, Inc., Indianapolis, IN (US)

(72) Inventor: Nathan W. Ottow, Indianapolis, IN (US)

(73) Assignee: Rolls-Royce North American Technologies, Inc., Indianapolis, IN (US)

( * ) Notice: Subject to any disclaimer, the term of this patent is extended or adjusted under 35 U.S.C. 154(b) by 830 days.

(21) Appl. No.: 14/143,567

(22) Filed: Dec. 30, 2013

(65) Prior Publication Data

US 2015/0016946 A1 Jan. 15, 2015

Related U.S. Application Data

(60) Provisional application No. 61/768,432, filed on Feb. 23, 2013.

(51) Int. Cl.
*F01D 11/22* (2006.01)
*F04D 29/42* (2006.01)
(Continued)

(52) U.S. Cl.
CPC ..... *F01D 11/22* (2013.01); *F04D 29/4206* (2013.01); *F04D 29/622* (2013.01); *F01D 5/043* (2013.01)

(58) Field of Classification Search
CPC ..... F01D 5/043; F01D 11/22; F04D 29/4206; F04D 29/622
See application file for complete search history.

(56) References Cited

U.S. PATENT DOCUMENTS 3,039,737 A * 6/1962 Kolthoff, Jr. ..... F01D 11/24 415/113
3,085,398 A 4/1963 Ingleson
(Continued)

FOREIGN PATENT DOCUMENTS

CA 1221034 A1 4/1987
DE 4309199 A1 9/1994
(Continued)

OTHER PUBLICATIONS

International Search Report for PCT International Application Serial No. PCT/US2013/078228, completed May 13, 2014, (11 pages).
(Continued)

*Primary Examiner* — Igor Kershteyn
(74) *Attorney, Agent, or Firm* — Barnes & Thornburg LLP

(57) ABSTRACT

An apparatus and method for controlling a clearance between the blades of a turbomachinery component and flow forming surface are disclosed herein, and includes controlling the clearance by moving the surface axially relative to the turbomachinery component. In one embodiment the apparatus includes an impeller rotatable about a first axis, a shroud encircling the impeller, and a first ring encircling the first axis. An actuator is operably engaged with the first ring to pivot the first ring about the first axis. The apparatus also includes at least one cam engaged with the first ring and at least one cam follower engaged with the shroud. Pivoting movement of the first ring about the first axis results in the at least one cam urging the at least one cam follower and the shroud along the first axis to vary a distance between the plurality of blades and the shroud.

20 Claims, 5 Drawing Sheets

(51) Int. Cl.
*F04D 29/62* (2006.01)
*F01D 5/04* (2006.01)

(56) References Cited

U.S. PATENT DOCUMENTS

| | | | | | |
|---|---|---|---|---|---|
| 3,854,843 | A | * | 12/1974 | Penny | F01D 11/18 415/197 |
| 4,069,662 | A | | 1/1978 | Redinger, Jr. | |
| 4,230,436 | A | | 10/1980 | Davison | |
| 4,264,271 | A | | 4/1981 | Libertini | |
| 4,358,926 | A | | 11/1982 | Smith | |
| 4,487,016 | A | | 12/1984 | Schwarz et al. | |
| 4,513,567 | A | | 4/1985 | Deveau et al. | |
| 4,598,542 | A | | 7/1986 | Reynolds | |
| 4,632,635 | A | | 12/1986 | Thoman et al. | |
| 4,657,479 | A | | 4/1987 | Brown et al. | |
| 4,683,716 | A | | 8/1987 | Wright et al. | |
| 4,714,404 | A | * | 12/1987 | Lardellier | F01D 11/22 15/171 |
| 4,815,928 | A | | 3/1989 | Pineo et al. | |
| 5,018,942 | A | * | 5/1991 | Ciokajlo | F01D 11/22 415/127 |
| 5,035,573 | A | | 7/1991 | Tseng et al. | |
| 5,048,288 | A | | 9/1991 | Bessette et al. | |
| 5,049,033 | A | * | 9/1991 | Corsmeier | F01D 11/22 415/127 |
| 5,054,997 | A | * | 10/1991 | Corsmeier | F01D 11/22 415/126 |
| 5,056,988 | A | * | 10/1991 | Corsmeier | F01D 11/22 415/126 |
| 5,064,343 | A | | 11/1991 | Mills | |
| 5,096,375 | A | * | 3/1992 | Ciokailo | F01D 11/22 415/127 |
| 5,104,287 | A | * | 4/1992 | Ciokajlo | F01D 11/22 415/126 |
| 5,116,199 | A | | 5/1992 | Ciokajlo | |
| 5,127,793 | A | | 7/1992 | Walker et al. | |
| 5,141,395 | A | * | 8/1992 | Carroll | F01D 11/005 415/189 |
| 5,212,940 | A | | 5/1993 | Glover | |
| 5,228,828 | A | | 7/1993 | Damlis et al. | |
| 5,261,228 | A | | 11/1993 | Shuba | |
| 5,344,284 | A | | 9/1994 | Delvaux et al. | |
| 5,407,320 | A | | 4/1995 | Hutchinson | |
| 5,553,999 | A | | 9/1996 | Proctor et al. | |
| 5,562,408 | A | | 10/1996 | Proctor et al. | |
| 5,593,277 | A | | 1/1997 | Proctor et al. | |
| 5,601,402 | A | | 2/1997 | Wakeman et al. | |
| 5,772,400 | A | | 6/1998 | Pellow | |
| 5,871,333 | A | | 2/1999 | Halsey | |
| 6,035,929 | A | | 3/2000 | Friedel et al. | |
| 6,089,821 | A | | 7/2000 | Maguire et al. | |
| 6,116,852 | A | | 9/2000 | Pierre et al. | |
| 6,273,671 | B1 | | 8/2001 | Ress, Jr. | |
| 6,393,331 | B1 | | 5/2002 | Chetta et al. | |
| 6,487,491 | B1 | | 11/2002 | Karpman et al. | |
| 6,652,227 | B2 | | 11/2003 | Fried | |
| 6,672,831 | B2 | | 1/2004 | Brandl et al. | |
| 6,722,137 | B2 | | 4/2004 | Proctor et al. | |
| 6,814,538 | B2 | | 11/2004 | Thompson | |
| 6,877,952 | B2 | | 4/2005 | Wilson | |
| 6,910,851 | B2 | | 6/2005 | Franconi et al. | |
| 6,925,814 | B2 | | 8/2005 | Wilson et al. | |
| 6,935,836 | B2 | | 8/2005 | Ress, Jr. et al. | |
| 6,942,445 | B2 | | 9/2005 | Morris et al. | |
| 7,096,673 | B2 | | 8/2006 | Little et al. | |
| 7,210,899 | B2 | | 5/2007 | Wilson, Jr. | |
| 7,422,413 | B2 | | 9/2008 | Matheny | |
| 2001/0023581 | A1 | | 9/2001 | Ojiro et al. | |
| 2004/0018084 | A1 | | 1/2004 | Halliwell et al. | |
| 2005/0050901 | A1 | | 3/2005 | Little | |
| 2005/0109016 | A1 | | 5/2005 | Ullyott | |
| 2005/0129499 | A1 | | 6/2005 | Morris et al. | |
| 2005/0238480 | A1 | | 10/2005 | Phipps et al. | |
| 2007/0003410 | A1 | | 1/2007 | Chehab | |
| 2007/0020095 | A1 | | 1/2007 | Dierksmeier et al. | |
| 2007/0110564 | A1 | | 5/2007 | Leach et al. | |
| 2008/0134659 | A1 | | 6/2008 | Schwarz et al. | |
| 2013/0202428 | A1 | | 8/2013 | Renard et al. | |

FOREIGN PATENT DOCUMENTS

| | | | |
|---|---|---|---|
| EP | 1930553 | A2 | 6/2008 |
| GB | 2068470 | A | 8/1981 |
| JP | 10196404 | A | 7/1998 |

OTHER PUBLICATIONS

Kawecki, E. J., Thermal Response Turbine Shroud Study, Jul. 1979, (139 pages).

* cited by examiner

BLADE CLEARANCE CONTROL FOR GAS TURBINE ENGINE

CROSS REFERENCE TO RELATED APPLICATIONS

This application claims priority to and the benefit of U.S. Provisional Patent Application No. 61/768,432, filed 23 Feb. 2013, the disclosure of which is now expressly incorporated herein by reference.

TECHNICAL FIELD

The present invention generally relates to control of clearance between blades and a flow forming surface in a gas turbine engine, and more particularly, but not exclusively, to control of clearance between blades of a centrifugal impeller and a shroud.

BACKGROUND

Providing the ability to control a clearance between a gas turbine engine turbomachinery component (e.g. a blade) and a flow forming surface remains an area of interest. Some existing systems have various shortcomings relative to certain applications. Accordingly, there remains a need for further contributions in this area of technology.

SUMMARY OF THE INVENTION

One embodiment of the present application is a unique mechanism that controls a clearance between a blade of a gas turbine engine turbomachinery component and a flow surface. Other embodiments include apparatuses, systems, devices, hardware, methods, and combinations for controlling blade clearance. Further embodiments, forms, features, aspects, benefits, and advantages of the present application shall become apparent from the description and figures provided herewith.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF EXEMPLARY EMBODIMENTS

Figure 1:
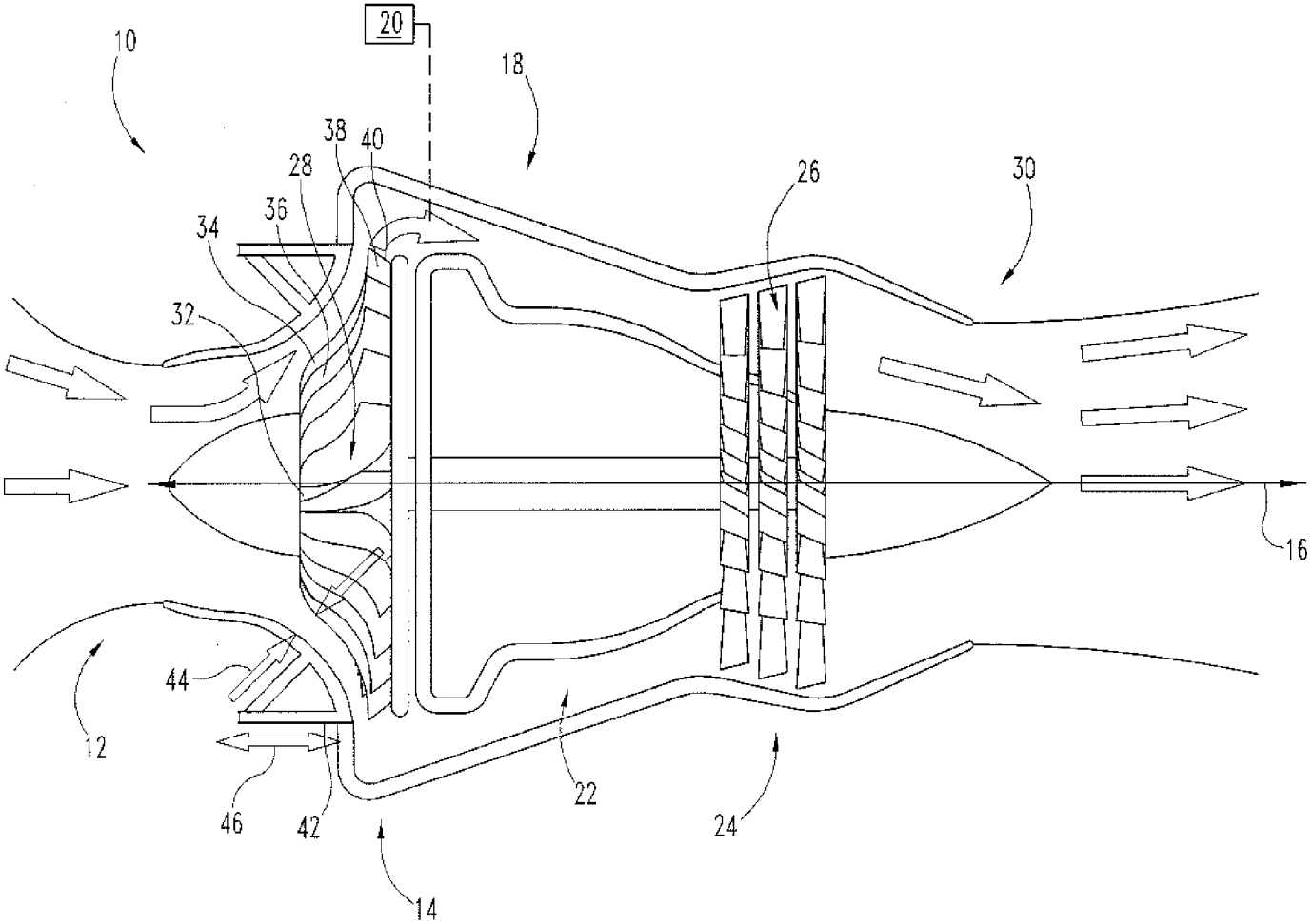
FIG. 1 is a schematic cross-section of a turbine engine incorporating an exemplary embodiment of the application.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

One aspect of the present application is the control of clearance between a blade of a turbomachinery component and a flow forming surface. Various embodiments below are directed at a compressor impeller of a gas turbine engine but it will be appreciated that similar approach could be taken with respect to turbine impeller as well as an axial flow turbomachinery component such as an axial flow compressor or axial flow turbine. Furthermore, the present application can be applied to control of clearance for gas turbine engine used to provide power to aircraft.

As used herein, the term "aircraft" includes, but is not limited to, helicopters, airplanes, unmanned space vehicles, fixed wing vehicles, variable wing vehicles, rotary wing vehicles, unmanned combat aerial vehicles, tailless aircraft, hover crafts, and other vehicles. Further, the present inventions are contemplated for utilization in other applications that may not be coupled with an aircraft such as, for example, industrial applications, power generation, pumping sets, naval propulsion, weapon systems, security systems, perimeter defense/security systems, and the like known to one of ordinary skill in the art.

FIG. 1 schematically shows a turbine engine 10. The various unnumbered arrows represent the flow of fluid through the turbine engine 10. The turbine engine 10 can produce power for several different kinds of applications, including vehicle propulsion and power generation, among others. The exemplary embodiments of the invention disclosed herein, as well as other embodiments of the broader invention, can be practiced in any configuration of a turbine engine and in any application other than turbine engines in which controlling the clearance between a centrifugal compressor and a shroud is desired.

The exemplary turbine engine 10 can include an inlet 12 to receive fluid such as air. The turbine engine 10 can include a compressor section 14 to receive the fluid from the inlet 12 and compress the fluid. The compressor section 14 can be spaced from the inlet 12 along a centerline axis 16 of the turbine engine 10. The turbine engine 10 can also include a combustor section 18 to receive the compressed fluid from the compressor section 14. The compressed fluid can be mixed with fuel from a fuel system 20 and ignited in an annular combustion chamber 22 defined by the combustor section 18. The turbine engine 10 can also include a turbine section 24 to receive the combustion gases from the combustor section 18. The combustion gases can pass over rows of turbine blades, such as row 26. The energy associated with the combustion gases can be converted into kinetic energy (motion) in the turbine section 24. The combustion gases can then exit the turbine engine 10 through an outlet 30, possibly generating thrust for a vehicle or passing over free power turbines to generate rotational power.

The turbine rows can be fixed for rotation with an impeller 28 of the compressor section 14. The kinetic energy can thus be applied to compressing the fluid. The impeller 28 is centered on the centerline axis 16 and operable to rotate about the centerline axis 16. The impeller 28 also includes a hub 32 and plurality of blades, such as blades 34 and 36, extending radially outward from the hub 32. The blades also extend along the centerline axis 16. A plurality of fluid channels are respectively defined between adjacent pairs of the plurality of blades. A channel between blades 34 and 36 is referenced at 38. The bottom of each channel can be defined by the hub 32 and the sides of each channel are defined the adjacent pairs of blades. Each of the plurality of channels includes a fluid channel exit directed radially outward relative to the centerline axis 16. An exit for the fluid channel 38 is referenced at 40. Compressed fluid travels radially outward upon exiting the impeller 28, specifically upon passing the fluid channel exits.

The apparatus also includes a shroud 42 encircling the impeller 28. The shroud 42 substantially encloses a radially outward side of the plurality of fluid channels along the centerline axis 16 up to the plurality of fluid channel exits. In other words, the shroud 42 does not block the fluid channel exits. A gap between the blades and the shroud 42 is referenced at 44. It can be desirable to minimize this gap 44, as explained above. The size of the gap 44 can vary if not controlled due to changes in the sizes of components in response to temperature changes. It can therefore be desirable to move the shroud 42 along the centerline axis 16, referenced at 46.

Figure 2:
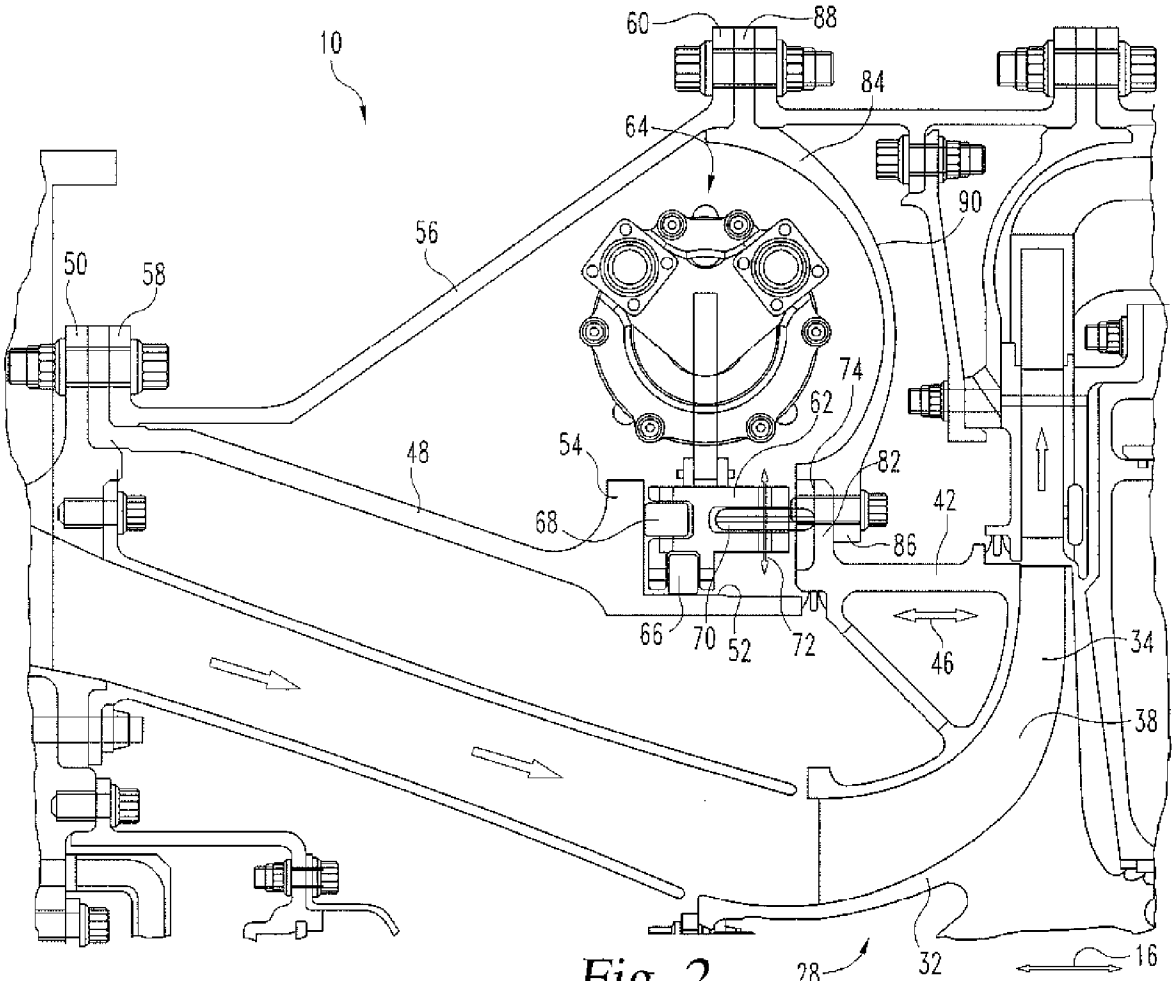
FIG. 2 is a detailed cross-section of a portion of a turbine engine incorporating an exemplary embodiment of the application.

A detailed cross-section of a portion of a turbine engine incorporating an exemplary embodiment of the invention is shown in FIG. 2. A first casing member 48 can be statically mounted to a portion 50 of a frame of the turbine engine. The cross-section of the first casing member 48 shown in FIG. 1 can be the cross-section of the first casing member 48 fully around the centerline axis 16 (shown in FIG. 1). The first casing member 48 can thus be a ring-like structure. The first casing member 48 can define a cylindrical surface 52 and a first annular flange 54 projecting radially outward from the cylindrical surface 52.

A second casing member 56 can be fixed to the first casing member 48, also being statically mounted to the portion 50 of the frame of the turbine engine 10. The cross-section of the second casing member 56 shown in FIG. 1 can be the cross-section of the second casing member 56 fully around the centerline axis 16. The second casing member 56 can thus be a ring-like structure. The second casing member 56 is fixed to the first casing member 48 at a first axial end 58 and extends away from the first axial end 58 along the centerline axis 16 to second axial end 60. The first and second casing members 48, 56 can diverge away from one another along the centerline axis 16.

A first ring 62 encircles the centerline axis 16. The first ring 62 is adjacent to at least part of the shroud 42 along the centerline axis 16. The first ring 62 can encircle and rotate about the cylindrical surface 52. An actuator 64 is operably engaged with the first ring 62 to pivot the first ring 62 about the centerline axis 16. For example, the actuator 64 can be electrical drive screw with one end pivotably connected to the first ring 62. Alternatively, the actuator 64 can be a hydraulic or pneumatic cylinder with a rod pivotably connected to the first ring 62. Extension of such a rod could pivot the first ring 62 in a first angular direction about the centerline axis 16 and retraction of the rod could pivot the first ring 62 in a second angular direction about the centerline axis 16, opposite the first angular direction.

A first plurality of rollers, such as roller 66, can be mounted on the first ring 62 and ride along the cylindrical surface 52. The first plurality of rollers can significantly reduce friction between the first ring 62 and the cylindrical surface 52. The first ring 62 can also abut the first annular flange 54. A second plurality of rollers, such as roller 68, can be mounted on the first ring 62 and ride along the annular flange 54. The second plurality of rollers can significantly reduce friction between the first ring 62 and the annular flange 54.

At least one cam 70 is engaged with the first ring 62. In the exemplary embodiment, a cam 70 is a wheel rotatable about a second axis 72 extending transverse to the centerline axis 16. Also, in the exemplary embodiment, a plurality of cams 70 are engaged with the first ring 62 and spaced from one another about the first ring 62. The cams 70 can be evenly spaced about the centerline axis 16.

At least one cam follower 74 is engaged with the shroud 42. Pivoting movement of the first ring 62 about the centerline axis 16 results in the at least one cam 70 urging the at least one cam follower 74 and the shroud 42 along the centerline axis 16 to vary a distance between the plurality of blades, such as blade 34 and the shroud 42. This changes the size of the gap 44 shown in FIG. 1. In the exemplary embodiment, the cam follower 74 can be a ramp. The cam follower 74 can be formed in a second annular flange 82 defined by the shroud 42. The second annular flange 82 confronts the first annular flange 54, with the first ring 62 disposed between the flanges 54, 82 in the exemplary embodiment. Although cam 70 has been associated with ring 62 and cam follower 74 with shroud 42, in some embodiments the ring can include a cam follower and the shroud can include a cam.

Figure 4:
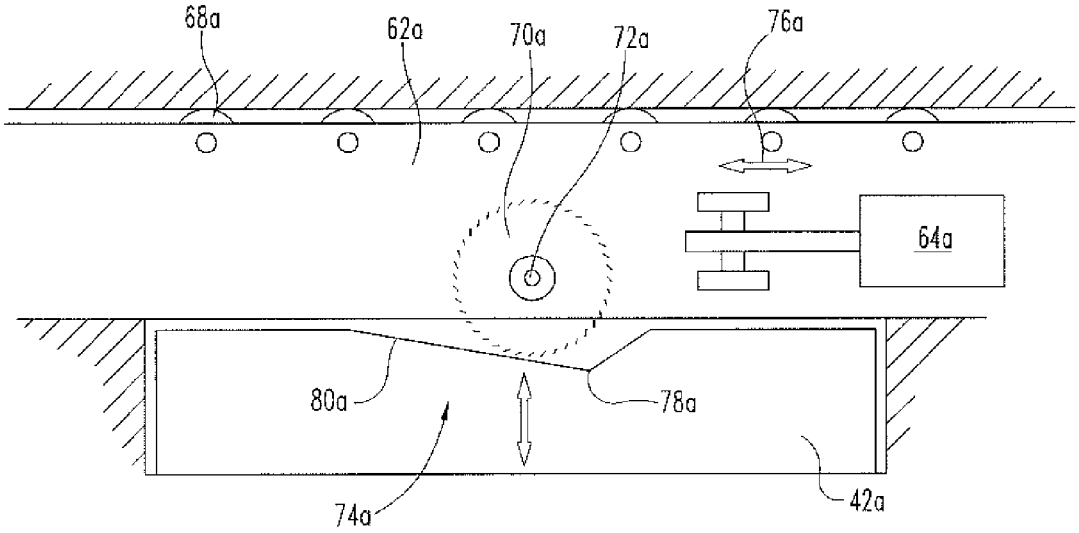
FIG. 4 is a top-down, planar view of an embodiment of the application.

FIG. 4 shows an embodiment of the invention in which a first ring **62*a* can be moved by an actuator 64*a* and is supported in movement (referenced at 76*a*) by rollers 68*a*. A cam 70*a* is mounted to the ring 62*a* to rotate about an axis 72*a*. A shroud 42*a* defines a cam follower 74*a*. The cam follower 74*a* can be a ramp having a bottom edge 78*a* and a top edge 80*a* spaced from one another about the centerline axis 16 and also along the centerline axis 16. In FIG. 4, the structures are arcuate but are shown "flattened" to better illustrate the structure of the ramp. As the cam 70*a* moves with the first ring 62*a* to the right (relative to the perspective of FIG. 4), the cam 70*a* rides up the cam follower ramp 74*a* and urges the shroud 42*a*** downward (toward the blades of the impeller).

In other embodiments of the invention, the cam follower **74*a* could be formed as a wheel and the cam 70*a* could be formed as a ramp. Also, in other embodiments of the invention, some of the cams 70*a* could be wheels and some of the cam followers 74*a* could be formed as wheels. For example, in one embodiment a plurality of wheels acting as cams 70*a* could be mounted for rotation on the first ring 62*a* and a plurality of ramps could also be formed in the first ring 62*a*, such as in alternating relation. A corresponding shroud 42*a* could define a plurality of ramps to individually mate with the wheels mounted on the first ring 62*a* and could also support a plurality of wheels that individually mate with the ramps defined by the first ring 62*a*. Various embodiments of the invention could apply any combination of mating wheels and ramps on the first ring 62*a* and shroud 42*a***.

It is desirable that the shroud **42*a* and the cam follower 74*a* move away from the blades of the impeller when the cam 70*a* moves with the first ring 62 to the left in FIG. 4. Referring again to FIG. 2, the exemplary embodiment of the invention can include a second ring or plate or spring 84 biasing the shroud 42 away from the impeller 28. Though the component 84 can be configured to bias the shroud 42 away from the impeller using a variety of approaches as will be appreciated, the illustrated approach discloses doing so by elastic deformation of the component 84. Thus, the component 84 will be referred to in some places herein as a spring, but no limitation is intended regarding the size/type/configuration/elastic properties/etc. of the component 84**.

The spring 84 can be elastically deformable in response to the cam 70 urging the cam follower 74 and the shroud 42 along the centerline axis 16 toward the blades 34 of the impeller 28. The spring 84 is operable to generate a biasing force urging the shroud 42 against the first ring 62. The shroud 42 is thus moved away from the impeller 28 when the cam 70 rolls down the ramp 74.

The spring 84 can be an integral/unitary/one-piece structure extending fully around the centerline axis 16. The spring 84 can extend axially between first and second ends 86, 88. The spring 84 can be fixed to the shroud 42 at the first end 86, a radially inner end, and fixed to the second casing member 56 at the second end 88. The first and second ends 86, 88 can be radially spaced from one another relative to the centerline axis 16 and also axially spaced from one another along the centerline axis 16.

Figure 3:
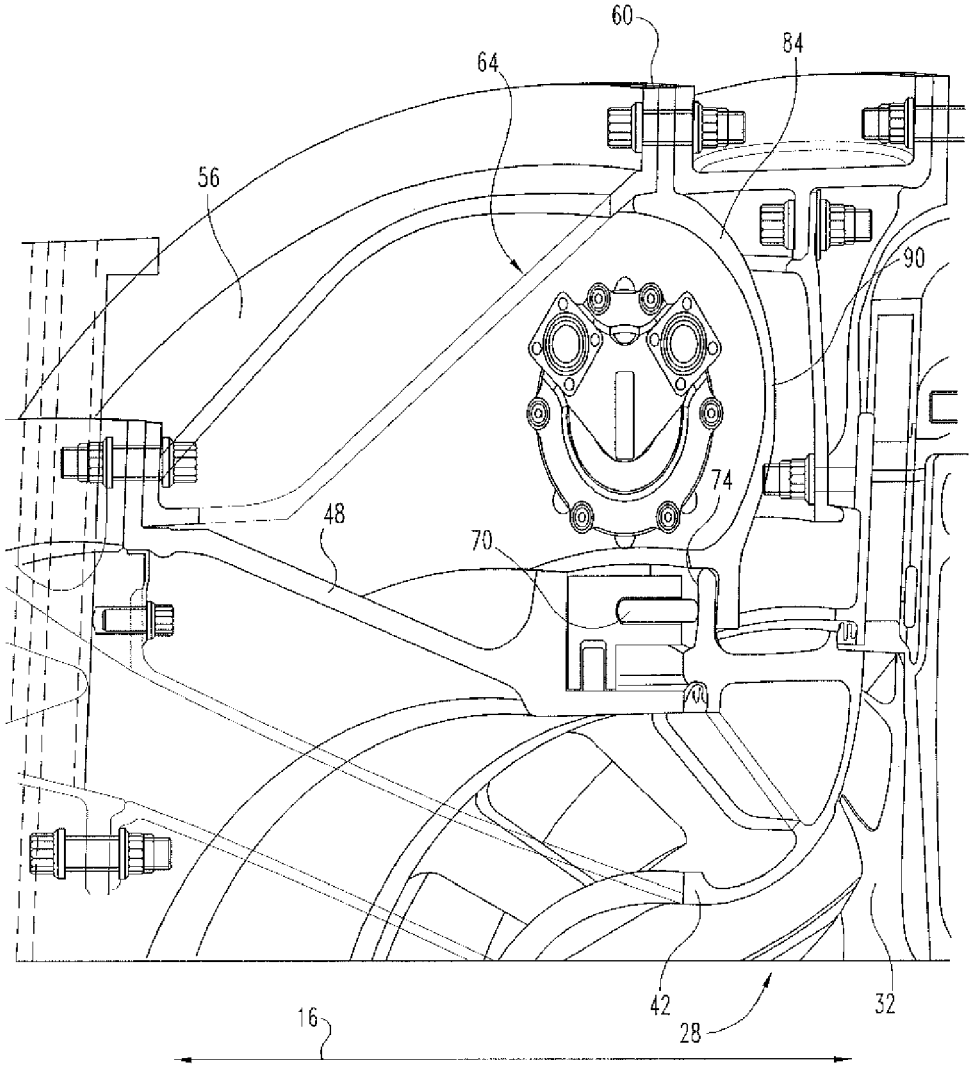
FIG. 3 is perspective view of the cross-section shown in FIG. 2.

The exemplary spring 84 can include a bulbous portion 90 between the first and second ends 86, 88. The shape of the spring 84 allows the actuator 64 to be at least partially received in the bulbous portion 90. The spring 84 can thus extend around the actuator 64 and conserve space for other components. FIG. 3 shows a profile of the actuator 64 disposed in an annular cavity defined by the first casing member 48, the second casing member 56, and the spring 84.

The alignment of the various structures can enhance the movement of the structures relative to one another. For example, each of the plurality of cams 70 can be radially aligned with the radially-inner end 86 of the spring 84. Further, the plurality of rollers 68 mounted on the first ring 62 and riding along the first annular flange 54 can be radially aligned with one of the plurality of cams 70. Thus, the forces urging movement of the shroud 42 toward the impeller 28 and the biasing forces acting oppositely are substantially aligned along an axis parallel to the centerline axis 16. Also, rolling elements, cam 70 and roller 68, are positioned between each structure to reduce the likelihood of binding.

In various forms the present application provides an apparatus and method for controlling a clearance between the blades of an impeller and a shroud. The apparatus includes an impeller centered on a first axis and operable to rotate about the first axis. The impeller also includes a hub and plurality of blades extending radially outward from the hub. The blades also extend along the first axis. A plurality of fluid channels are respectively defined between adjacent pairs of the plurality of blades. Each of the plurality of channels includes a fluid channel exit directed radially outward relative to the first axis. The apparatus also includes a shroud encircling the impeller. The shroud substantially encloses a radially outward side of the plurality of fluid channels along the first axis up to the plurality of fluid channel exits. The apparatus also includes a first ring encircling the first axis. The first ring is adjacent to at least part of the shroud along the first axis. The apparatus also includes an actuator operably engaged with the first ring to pivot the first ring about the first axis. The apparatus also includes at least one cam engaged with the first ring. The apparatus also includes at least one cam follower engaged with the shroud. Pivoting movement of the first ring about the first axis results in the at least one cam urging the at least one cam follower and the shroud along the first axis to vary a distance between the plurality of blades and the shroud. The at least one cam or the at least one cam follower is a wheel rotatable about a second axis extending transverse to the first axis.

Figure 5:
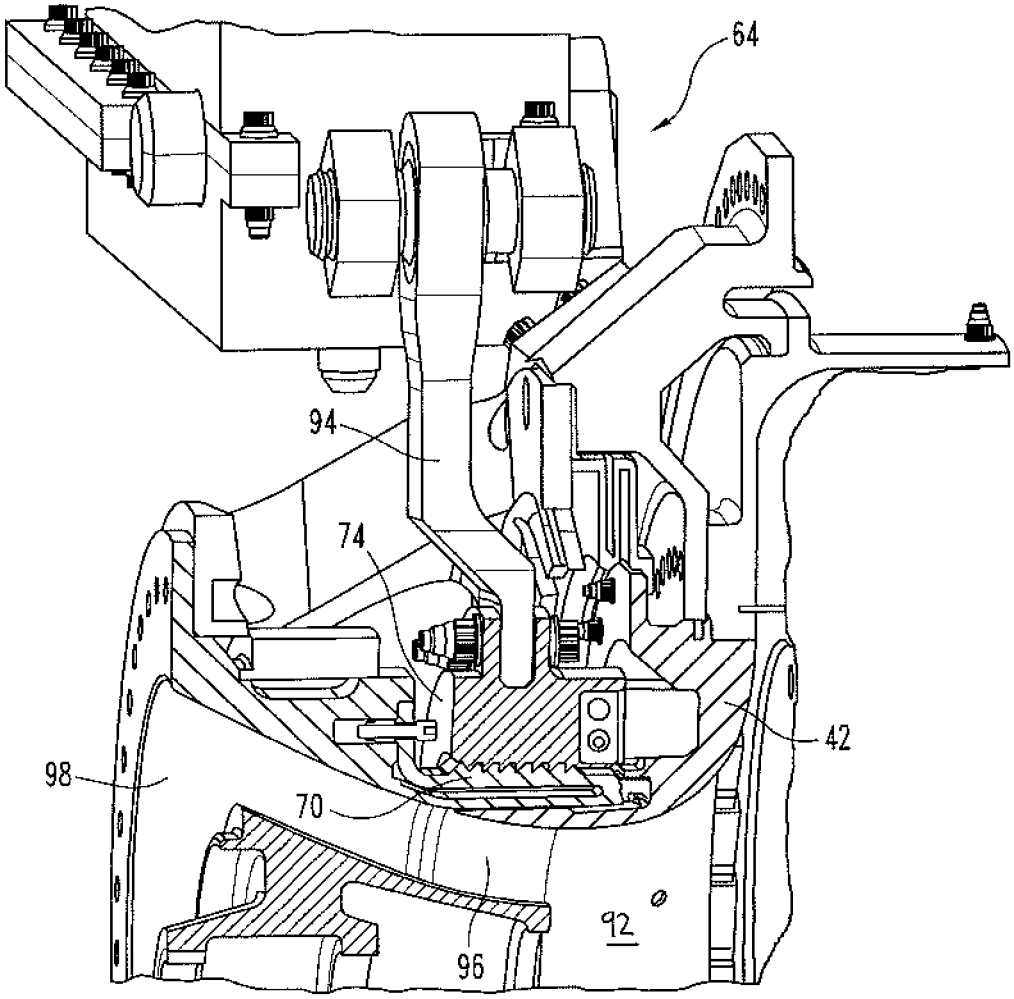
FIG. 5 is a view of another embodiment of the application

FIG. 5 discloses another embodiment of the present application in which the cam 70 and cam follower 74 can take the form of complementary shaped sloped surfaces. In the embodiment depicted in FIG. 5, the complementary sloped surfaces are in the form of a threaded interconnection between the cam 70 and cam follower 74. The embodiment depicted in FIG. 5 is shown without the impeller 28, but it will be appreciated that the impeller, when used, resides in the open space 92.

The threaded interconnection and support arrangement of the shroud 42 can take a variety of forms. For example, the threaded interconnection can be an annular threaded interconnection in some embodiments, and in others the threaded interconnection may only be provide over a smaller circumferential extent. Accordingly the cam 70 and/or cam follower 74 can be fully annular components or partial annular components. In still further alternative and/or additional embodiments, a single thread can be provided that encircles an annular cam 70 or cam follower 74 multiple times (which can constitute a number of cams and cam followers as shown in the illustrated embodiment), but in other forms the threads can be represented by numerous separate sloped landings where the cam 70 and/or cam follower 74 are disposed over different circumferential reaches of the device. In some forms the threaded interconnection can be a multi-start thread, and any of other variations are also contemplated herein.

When the actuator 64 is moved, a link arm 94 is caused to move which in turn rotates the cam follower 74 about the centerline axis 16. As the threaded interconnection interacts with the cam 70, the cam follower 74 is moved in the axial direction. The shroud 42 is connected to the cam follower 74 and is likewise moved in the axial direction. The shroud 42 can represent the entirety of the flow path surface that forms the inlet and through-passage of the turbomachinery component, but the illustrated form also depicts another variation wherein a split-line 96 is provided between the moveable shroud 42 and a flow path frame 98. The split line permits relative sliding motion between the shroud 42 and the flow path frame 98.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. An apparatus comprising:

a gas turbine engine bladed turbomachinery component centered on a first axis and operable to rotate about said first axis, said bladed turbomachinery component including an inner base and a plurality of blades extending radially outward from said inner base and also extending along said first axis, wherein a plurality of fluid channels are respectively defined between adjacent pairs of said plurality of blades;

a flow path forming component encircling said bladed turbomachinery component and substantially enclosing a radially outward side of said blades along said first axis;

a pivoting member circumferentially extending about said first axis and adjacent to at least part of said flow path forming component along said first axis;

an actuator operably engaged with said pivoting member to pivot said pivoting member about said first axis;

at least one cam engaged with said pivoting member; and at least one cam follower engaged with said flow path forming component, wherein pivoting movement of said pivoting member about said first axis results in said at least one cam urging said at least one cam follower and said flow path forming component along said first axis to vary a distance between said plurality of blades and said flow path forming component.

2. The apparatus of claim 1, wherein the bladed turbomachinery component is an impeller, wherein each of said plurality of channels includes a fluid channel exit directed radially outward relative to said first axis, wherein one of said at least one cam and said at least one cam follower is a wheel rotatable about a second axis extending transverse to said first axis and wherein the other of said at least one cam and at least one cam follower is a ramp having a bottom edge and a top edge spaced from one another about said first axis and also along said first axis.

3. The apparatus of claim 1, wherein the pivoting member is a first ring, and further comprising:

a second ring circumferentially extending about said first axis and extending between first and second ends, wherein said first end is fixed said flow path forming component, said ring being elastically deformable in response to said cam urging said cam follower and said flow path forming component along said first axis to vary a distance between said plurality of blades and said flow path forming component; and wherein the flow path forming component is a shroud, and wherein the turbomachinery component is an impeller.

4. The apparatus of claim 3, wherein said first end and said second end are radially spaced from one another relative to said first axis.

5. The apparatus of claim 3, wherein said second ring includes a bulbous portion between said first and second ends, and wherein said actuator is at least partially received in said bulbous portion.

6. The apparatus of claim 1, wherein the cam and cam follower are in sliding engagement.

7. The apparatus of claim 6, wherein the sliding engagement is defined by a threaded engagement and wherein the cam and cam follower are annular.

8. A method comprising:

spinning a gas turbine engine bladed component within a flow path surface about a first axis to change a pressure of a working fluid;

moving a pivoting member about the first axis in a circumferential direction;

interacting a cam and a cam follower as the pivoting member moves circumferentially; and axially adjusting the flow path surface to adjust a clearance between the flow path surface and the gas turbine engine bladed component as a result of the interacting.

9. The method of claim 8, further comprising:

actuating a shaft to cause the moving;

wherein the cam takes the form of one of a wheel and a ramp; and wherein the gas turbine engine bladed component is a centrifugal impeller.

10. The method of claim 8, further comprising:

wherein the axially adjusting includes biasing the flow path surface away from the gas turbine engine bladed component with a plate extending fully around the first axis and fixed to the flow path surface at a radially inner end;

wherein the flow path surface is a shroud; and wherein the gas turbine engine bladed component is a gas turbine engine impeller.

11. The method of claim 10, further comprising:

engaging the pivoting member to a static engine structure through a roller; and interconnecting a radially-outer end of the plate with a static structure.

12. The method of claim 8, wherein: the interacting includes slidingly interacting the cam and cam follower.

13. A turbine engine comprising:

a gas turbine engine bladed turbomachinery component centered on a first axis and operable to rotate about said first axis, said bladed turbomachinery component including a base and plurality of blades extending radially outward from said base and also extending along said first axis, wherein a plurality of fluid channels are respectively defined between adjacent pairs of said plurality of blades;

a flow path forming surface encircling said bladed turbomachinery component and substantially enclosing an outward side of said blades;

a pivoting member encircling said first axis and adjacent to at least part of said flow path forming surface along said first axis;

an actuator operably engaged with said pivoting member to pivot said pivoting member about said first axis;

a plurality of cams engaged with and spaced from one another about said pivoting member; and a plurality of cam followers engaged with and spaced from one another about said flow path forming surface, wherein pivoting movement of said pivoting member about said first axis results in each of said plurality of cams urging a corresponding one of said plurality of cam followers and said flow path forming surface along said first axis to vary a distance between said plurality of blades and said flow path forming surface.

14. The turbine engine of claim 13, wherein the pivoting member is a ring, and wherein each of said plurality of cams are respective wheels rotatable about individual second axes extending transverse to said first axis, wherein the flow path forming surface is a shroud, and wherein each of said plurality of channels includes a fluid channel exit directed radially outward relative to said first axis.

15. The turbine engine of claim 13, further comprising:

a first casing member defining a cylindrical surface and an annular flange projecting radially outward from said cylindrical surface, wherein said pivoting member encircles said cylindrical surface and abuts said annular flange;

a first plurality of rollers mounted on said pivoting member and riding along said cylindrical surface; and a second plurality of rollers mounted on said pivoting member and riding along said annular flange;

wherein the gas turbine engine bladed turbomachinery component is an impeller.

16. The turbine engine of claim 13, further comprising:

a first casing member defining a cylindrical surface and a first annular flange projecting radially outward from said cylindrical surface, wherein said pivoting member encircles and rotates about said cylindrical surface and abuts said first annular flange;

a second casing member fixed to said first casing member at a first axial end and extending away from said first axial end along said first axis to second axial end;

a spring fixed at a radially-outer end to said second axial end of said second casing member and fixed at a radially-inner end to said flow path forming surface, said spring operable to generate a biasing force urging said flow path forming surface against said pivoting member; and wherein the gas turbine engine bladed turbomachinery component is an impeller.

17. The turbine engine of claim 16, further comprising:

a plurality of rollers mounted on said pivoting member and riding along said first annular flange, each of said plurality of rollers radially aligned with one of said plurality of cams.

18. The turbine engine of claim 17, wherein said flow path forming surface includes a second annular flange confronting said first annular flange and wherein each of said plurality of cam followers is further defined as a ramp formed in said second annular flange and facing toward said first annular flange, and wherein said actuator is disposed in an annular cavity defined by said first casing member, said second casing member, and said spring.

19. The turbine engine of claim 13, wherein the plurality of cams and plurality of cam followers are distributed axially along the first pivoting member.

20. The turbine engine of claim 19, wherein the plurality of cams and plurality of cam followers are defined by a threaded interengagement that helically wraps circumferentially around the first pivoting member.

* * * * *